United States Patent [19]

Howie, Jr.

[11] Patent Number: 4,467,515

[45] Date of Patent: Aug. 28, 1984

[54] METHOD OF FINISHING ALUMINUM SHEETS

[75] Inventor: Robert K. Howie, Jr., Decatur, Ill.

[73] Assignee: The Grigoleit Company, Decatur, Ill.

[21] Appl. No.: 345,750

[22] Filed: Feb. 4, 1982

[51] Int. Cl.[3] ..... B21B 1/46

[52] U.S. Cl. ..... 29/527.2; 29/527.4

[58] Field of Search ..... 29/527.5, 527.6, 527.2, 29/527.1, 527.7

[56] References Cited

U.S. PATENT DOCUMENTS 2,102,162 12/1937 Nierenberg ..... 29/527.4

FOREIGN PATENT DOCUMENTS 2616789 3/1977 Fed. Rep. of Germany ..... 29/527.6

OTHER PUBLICATIONS

ASM Metals Handbook, vol. 2, 8th Ed., ©1964, pp. 614 & 615.

Surface Treatment of Metal, by Dr. F. A. Morral, *Wire*, Apr. 1945, pp. 272–273 & 276.

*Primary Examiner*—Howard N. Goldberg
*Assistant Examiner*—V. K. Rising
*Attorney, Agent, or Firm*—Kinzer, Plyer, Dorn & McEachran

[57] ABSTRACT

A method of finishing a rectangular sheet of bright aluminum to provide a central rectangular portion surrounded on its four sides by a brushed satin border. The method of the invention includes the steps of brushing the bright aluminum surface along a pair of narrow bands extending the entire length of the rectangular sheet with the narrow bands being spaced laterally from each other, and brushing the opposite ends of the aluminum sheet between the narrow bands for predetermined relatively short distances inward from the end edges of the sheet. The method further includes sharpening the definition between the brushed satin and bright areas by such procedures as providing a slight bend in the sheet or painting the bright area with the painting extending into the brushed area to provide a sharp transition line.

5 Claims, 5 Drawing Figures

23
19
17
13
21
11
15
17
25
31
-27-
29
29
25
31

15
11
13
33
35
17
21
15
23
19
17
31
25
21
-27-
29
29
25
31

21
15
37
41
35
33
-39-
21
25
43
25
43
41
11
37
21

53
55
51
35
19
23
25
21
25
27
21
37

35
11
21
-39-
25
25
21
37

METHOD OF FINISHING ALUMINUM SHEETS

BACKGROUND OF THE INVENTION

Bright aluminum sheets of rectangular shape have been used as instrument and control panels for household appliances such as stoves, dishwashers, clothes dryers, washing machines, etc. For aesthetic purposes, portions of the bright aluminum sheets formed into the panels have been brushed to provide satin borders around both painted and unpainted bright areas of the panels. In the past, in order to provide a brushed satin area along with bright areas on an aluminum sheet, it was necessary to apply a resist coating to the surface of the bright aluminum sheet that was to remain bright, brush the entire surface of the sheet and then remove the resist coating, leaving a sheet with both bright and brushed satin areas. The application and removal of the resist coating added to the cost of manufacturing these instrument and control panels.

SUMMARY OF THE INVENTION

This invention is concerned with a method which provides brushed satin finish on portions of aluminum sheets without using a resist coating.

An object of this invention is a method which provides brushed satin surfaces on portions of a bright aluminum sheet without requiring the application and removal of a resist coating.

Another object of this invention is a method for finishing a rectangular sheet of bright aluminum to provide a central bright area surrounded on its four sides by a brushed satin border without using a resist coating.

Another object of this invention is to finish a rectangular sheet of bright aluminum by providing a central painted rectangular portion surrounded on its sides by a brushed satin border without requiring the use of a resist coating.

Another object of this invention is a method for finishing a rectangular sheet of bright aluminum to provide a central area surrounded on its four sides by a brushed satin border which central area may be partially or entirely painted or partially or entirely bright.

Other objects may be found in the following specification, claims and drawings.

BRIEF DESCRIPTION OF THE DRAWINGS

The invention is illustrated more or less schematically in the following drawings wherein.

DESCRIPTION OF THE PREFERRED EMBODIMENTS

Figure 1:
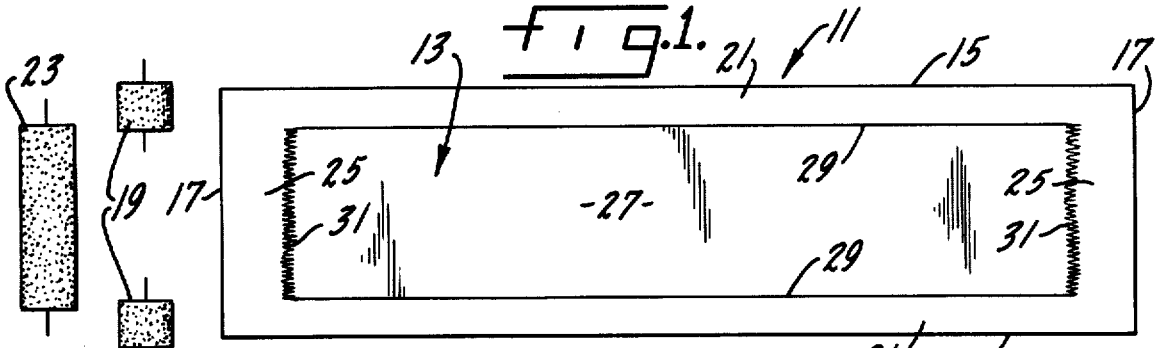
FIG. 1 is a schematic showing of one method of the invention for finishing the surface of a rectangular sheet of bright aluminum to provide a central bright area surrounded on its sides by a brushed satin border.

FIG. 1 of the drawings shows the method of this invention as applied to the finishing of a rectangular sheet 11 of aluminum having a bright surface 13. A bright surface as used by those skilled in the art refers to the unoxidized luster of the surfaces of an aluminum sheet. The rectangular sheet has longitudinal edges 15 and transverse or end edges 17. In practicing the method of the invention, the rectangular sheet 11 is passed under a pair of transversely spaced finishing wheels or brushes 19 which are positioned to engage the bright surface 13 of the sheet adjacent opposite longitudinal edges 15 thereof to form a pair of spaced apart narrow bands 21 having brushed satin finishes. A third wheel or brush 23 which is sufficiently wide to bridge the transverse space between the brushes or wheels 19 is positioned adjacent these brushes. The brush 23 is mounted to be moved vertically into and out of contact with the bright surface 13 of the sheet 11 as the sheet moves beneath this brush to thereby form brushed satin areas 25 at the opposite ends of the sheet 11 adjacent its transverse edges 17. The ends of the brushed satin finish areas 25 overlap the narrow bands of brushed satin finish 21 to form a border around a center bright area 27. If desired, one or more areas of a brushed satin finish could be formed within the bright center area 27 through the use of a fourth wheel or brush but this is not shown in the drawings.

The transitional zones between the center bright area 27 and the narrow brushed satin finish bands 21 are indicated by straight lines 29 while the transitional zones between the center bright area 27 and the end brushed satin finish areas 25 are indicated by wavy lines 31. It should be understood that the transitional zones 29 and 31, and especially the transitional zones 29, may not be as clearly defined on the finished sheets as is indicated in the drawings which are merely graphic depictions of the invention. The definition of the transition zone 29 depends upon the edge provided on the wheel or brush 19 and this may vary considerably. Depending on the aesthetics desired in the finished instrument or control panel, an absolutely line sharp transition between the center bright surface and the brushed satin finish of the border may not be desired. Further, it is possible to conceal the transition zone in many ways; one of which would be to provide a slight bend along each of the transition zones 29.

The transition zones between the end brushed satin finish areas 25 and the center bright area 27 indicated by the wavy lines 31 will not be as definitive as those provided for the zones 29. The wheel 23 is raised or bounced out of and back into contact with the bright surface 13 of the rectangular sheet 11 as the sheet runs under this brush. Assuming that the rectangular sheet 11 of aluminum is moving from left to right as shown in the drawings of FIG. 1, the brush 23 will be in its lower position as the end edge 17 on the right side of the rectangular sheet engages the brush. The brush 23 will be raised after momentary contact with the aluminum sheet. The wheel 23 will then be lowered to re-engage the polished surface 13 of the sheet 11 before the opposite end edge 17 of the sheet passes under the wheel 23.

Figure 2:
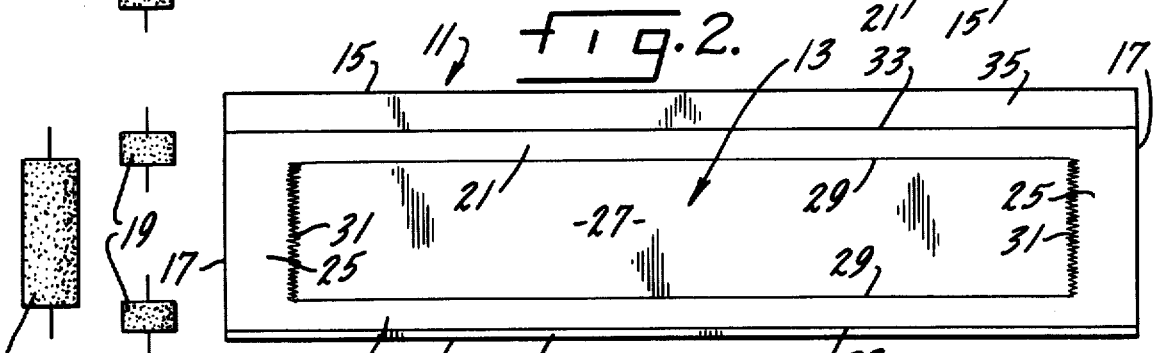
FIG. 2 is a schematic showing of the method of the invention for finishing the surface of a rectangular sheet of bright aluminum to provide a central bright area surrounded on its sides by a brushed satin border which border does not extend to the longitudinal edges of the rectangular sheet.

FIG. 2 of the drawings shows the method of this invention applied to a rectangular sheet 11 of aluminum having a bright surface 13 to provide a central bright area 27 surrounded by a satin finish border with the border extending to the edges of the aluminum sheet only at the transverse ends 17 of the sheet. In this method of the invention, the brushes 19 are spaced apart but are located at predetermined distances inwardly of the longitudinal side edges 15 of the rectangular sheet. As the aluminum sheet passes under these brushes, narrow bands 21 of brushed satin finish are formed having inner transition zones indicated by the lines 29 and outer transition zones indicated by the lines 33. Adjacent the end edges 17 of the rectangular sheet, the brushed satin finish border areas 25 extend to the edges of the sheet and each inner edge is defined by the transition zones 31. The longitudinally extending areas or bands 35 and 37 will have bright aluminum surfaces, the same as the central bright area 27.

The zones 29 and 33 defining the transition between the brushed satin finish bands 21 and the portions of bright aluminum will not be as clearly defined as indicated by the lines but will vary in accordance with the type of edge provided by the wheels or brushes 19. The same is true for the zones 31 indicating the transitions between the brushed satin finish end zones 25 and the bright central area 27.

Figure 3:
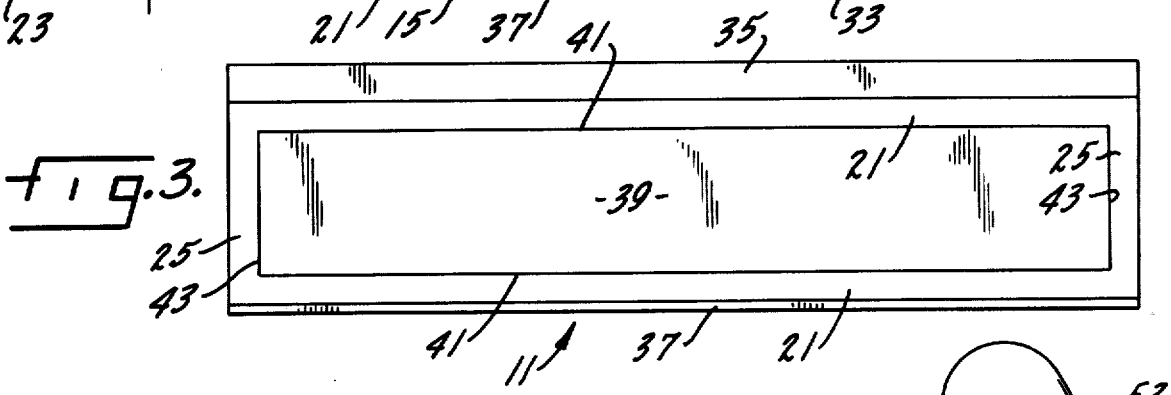
FIG. 3 is a schematic view of the rectangular sheet of FIG. 2 with a central painted rectangular portion applied to the surface of the sheet.

In some types of instrument and control panels, such as the type shown in FIG. 3 of the drawings, it is desirable to provide a central rectangular painted area rather than the central rectangular bright area 27 of the type shown in FIGS. 1 and 2 of the drawings. In such circumstances, a rectangular painted area 39 is applied by silk screening or other conventional painting procedures to overlap the central bright area 27. By applying the painted area 39 so that it covers the transition zones 29 and 31, any lack of definition of these zones is obscured and at least the inner edges 41 and 43 of the brushed satin finish border areas are provided with sharp definition. The bands 35 and 37 may also be painted or may remain as bright aluminum. Bright areas may be provided within the central painted area by not applying paint to these areas. It should also be understood and appreciated that the paint may be applied in patterns other than rectangular but for ease of application and because of the rectangular shape of the aluminum sheets, a rectangular pattern is preferred.

Figure 4:
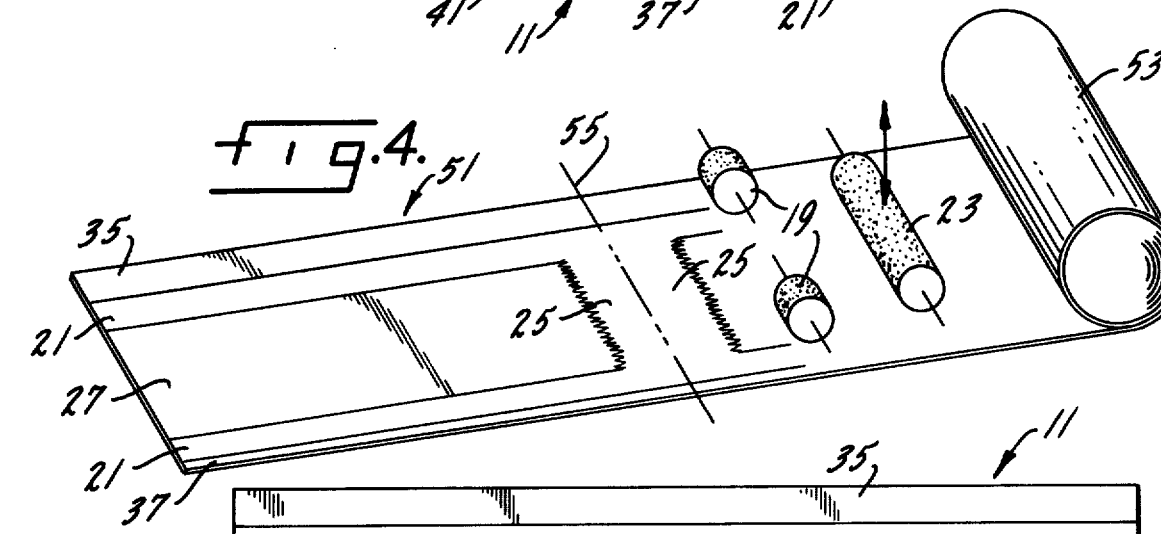
FIG. 4 is a schematic view showing the method of this invention applied to rectangular sheets formed from a web of bright aluminum.

FIG. 4 schematically shows the application of the method of this invention to a continuous strip 51 of aluminum being unwound from a roll 53 to produce a finished product of the type shown in FIG. 2 of the drawings. Rollers 19 engage the sheet 51 to apply narrow bands 21 of brushed satin finish along the length of the sheet. A wheel or brush 23 is raised and lowered in a predetermined sequence of operation to provide central brushed satin finish areas 25 and leaving center bright areas 27 in the same manner as shown in FIG. 2. The continuous sheet 51 is cut at spaced intervals along lines 55 to divide the strip into the rectangular sheets 11.

Figure 5:
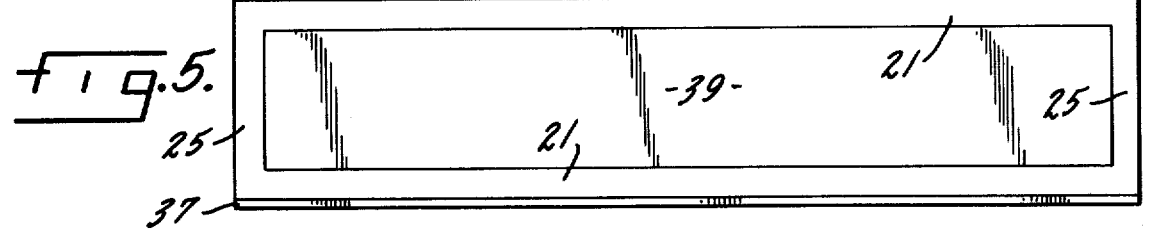
FIG. 5 is a view of a finished rectangular sheet of aluminum formed from the web of FIG. 4.

FIG. 5 of the drawings shows a rectangular sheet 11 formed from a strip 51 and finished in the same manner as shown in FIG. 3 of the drawings, that is, having a central painted area 39 surrounded by a brushed satin finish border comprised of side areas 21 and end areas 25.

I claim:

1. A method of finishing a rectangular sheet of bright aluminum to provide an at least partially painted central rectangular area surrounded on all four sides by a brushed satin border with the border on the ends on the painted rectangular area extending to the edges of the aluminum sheet, including the steps of:

moving a continuous strip of aluminum having a width equal to the desired width of the finished sheet past a pair of laterally spaced brushes, applying the brushes continuously to the moving strip of aluminum to form a pair of narrow bands of brushed surface extending the entire length of the strip with the narrow bands being located inwardly of the longitudinal edges of the strip, brushing the strip intermittently to provide brushed areas between the narrow bands of brushed surface with the brushed areas being of predetermined length and spaced predetermined distances, applying at least partially painted rectangular areas to the surface of the strip with each at least partially painted rectangular area being located between and overlapping the brushed narrow bands and extending between adjacent brushed areas between bands with the at least partially painted rectangular areas overlapping but not entirely covering adjacent brushed areas to form a border of brushed satin finish around all sides of each at least partially painted rectangular area, and cutting the strips with laterally extending cuts across the intermittently spaced brushed areas and between at least partially painted rectangular areas to provide rectangular sheets having at least partially painted rectangular central areas with a brushed satin border at the smaller ends of the sheet extending to the edges of the sheet.

2. A method of finishing a rectangular sheet of bright aluminum to provide a sheet having an at least partially painted central area surrounded by a brushed satin border with the border on the ends of the painted area extending to the edges of the aluminum sheet which method does not require the application of resist coating to the aluminum sheet, the method including the steps of:

brushing the surface of the aluminum sheet along a pair of narrow bands extending substantially the entire length of the rectangular sheet to form on the surface of the sheet a pair of narrow bands of brushed satin finish which extend along the longitudinal edges of the sheet and are spaced apart from each other with each narrow band of brushed satin finish having a narrower transition zone of partially brushed satin finish at least on the inner edge thereof, brushing the opposite ends of the rectangular aluminum sheet between the narrow bands of brushed satin finish for predetermined relatively short distances extending inwardly from the end edges of the aluminum sheet with the brushed end areas thus formed being spaced a considerable distance from each other with each brushed end area having a narrower transition zone of partially brushed satin finish along the inner edge thereof, and applying an at least partially painted central area to the surface of aluminum sheet with the painted area overlapping at least the inner narrower transition zones of the brushed narrow bands and the narrower transition zones of the brushed end areas of the sheet but not entirely covering the narrow brushed bands and the brushed end areas to provide a brushed satin finish border around all sides of the central painted area.

3. The method of claim 2 in which the pair of narrow bands of brushed satin finish are applied inwardly of the longitudinal edges of the rectangular aluminum sheet and each narrow band has a narrower transition zone of partially brushed satin finish on each longitudinally extending edge thereof.

4. A method of finishing a rectangular sheet of bright aluminum to provide a sheet with a central bright area surrounded on its four sides by a brushed satin finish border without applying a resist coating to the aluminum sheet, the method including the steps of:

brushing the aluminum surface of the sheet along a pair of narrow bands extending substantially the entire length of the rectangular sheet to form on the surface of the aluminum sheet a pair of narrow bands of brushed satin finish which extend along the longitudinal edges of the sheet and are spaced apart from each other with each narrow band of satin finish having a narrower transition zone on at least the inner edge thereof, brushing the opposite ends of the rectangular aluminum sheet between the narrow bands of brushed satin finish for predetermined relatively short distances extending inwardly from the end edges of the sheet with the brushed end areas thus formed being spaced a considerable distance from each with each brushed end area having a narrower transition zone of partially brushed satin finish at the inner edge thereof.

5. The method of claim 4 in which the narrower transition zone is obscured by bending the sheet slightly along the zone.

* * * * *